US006957740B2

(12) United States Patent
Hoffmann

(10) Patent No.: US 6,957,740 B2
(45) Date of Patent: Oct. 25, 2005

(54) CYCLONE SEPARATOR WITH CENTRAL BUILT-IN ELEMENT

(75) Inventor: Peter Hoffmann, Bergisch-Gladbach (DE)

(73) Assignee: Hosokawa Micron GmbH, Cologne (DE)

( * ) Notice: Subject to any disclaimer, the term of this patent is extended or adjusted under 35 U.S.C. 154(b) by 176 days.

(21) Appl. No.: 10/312,103

(22) PCT Filed: Jun. 6, 2001

(86) PCT No.: PCT/EP01/06411

§ 371 (c)(1),
(2), (4) Date: Jun. 16, 2003

(87) PCT Pub. No.: WO01/97976

PCT Pub. Date: Dec. 27, 2001

(65) Prior Publication Data

US 2004/0108256 A1 Jun. 10, 2004

(30) Foreign Application Priority Data

Jun. 23, 2000 (DE) ..... 100 30 705

(51) Int. Cl.[7] ..... B07B 1/00

(52) U.S. Cl. ..... 209/132; 204/133; 204/138; 204/716; 204/731

(58) Field of Search ..... 209/132, 133, 209/138, 143

(56) References Cited

U.S. PATENT DOCUMENTS

| | | | | | |
|---|---|---|---|---|---|
| 400,391 | A | * | 3/1889 | Bretney | 55/339 |
| 1,761,627 | A | * | 6/1930 | Hine | 209/135 |
| 2,792,910 | A | * | 5/1957 | Redniss | 55/425 |
| 3,306,443 | A | * | 2/1967 | Drake et al. | 209/136 |
| 3,687,286 | A | * | 8/1972 | Weiss | 209/135 |
| 3,802,570 | A | * | 4/1974 | Dehne | 210/304 |
| 3,855,951 | A | * | 12/1974 | Giles | 110/216 |
| 4,486,207 | A | * | 12/1984 | Baillie | 55/455 |
| 4,865,751 | A | * | 9/1989 | Smisson | 210/788 |
| 4,872,973 | A | * | 10/1989 | Ikebuchi et al. | 209/716 |
| 5,201,422 | A | | 4/1993 | Ihara et al. | 209/144 |
| 5,458,245 | A | * | 10/1995 | Heckel et al. | 209/139.1 |
| 5,938,045 | A | * | 8/1999 | Makino et al. | 209/713 |
| 6,206,202 | B1 | | 3/2001 | Galk et al. | 209/715 |
| 6,712,216 | B2 | * | 3/2004 | Van Oirschot | 209/138 |

FOREIGN PATENT DOCUMENTS

| | | | | | |
|---|---|---|---|---|---|
| DE | 1292479 | | | 4/1969 | |
| DE | 2121894 | | | 12/1972 | |
| DE | 3440108 | A1 | * | 5/1986 | B03B/5/34 |
| DE | 69100883 | | | 5/1994 | |
| DE | 19608142 | | | 9/1997 | |
| EP | 468426 | | | 1/1992 | |
| FR | 1123112 | | | 9/1956 | |
| FR | 2548050 | A1 | * | 1/1985 | B04C/5/08 |
| FR | 2580195 | | | 10/1986 | |
| GB | 2166068 | A | * | 4/1986 | B04C/5/13 |
| JP | 05301080 | A | * | 11/1993 | B07B/7/83 |
| JP | 406055102 | A | * | 3/1994 | B04C/5/04 |
| JP | 11028424 | | | 2/1999 | |

* cited by examiner

*Primary Examiner*—Donald P. Walsh
*Assistant Examiner*—Jonathan R. Miller
(74) *Attorney, Agent, or Firm*—Fay, Sharpe, Fagan, Minnich & McKee, LLP

(57) ABSTRACT

A cyclone separator (1) has a vertically extending housing (2) with an upper housing segment (3). A separator (6) with a separator wheel is located in the upper housing segment along with a carrier gas/product inlet (7), and a carrier gas/fines discharge (8). A lower housing segment (5) is equipped with a coarse grain discharge (14). In order to increase the operating range of the cyclone separator, the lower opening of the central built-in element (10) is located at the level of the conical middle housing segment (4) and that below the lower opening is disposed a conical built-in element (11), which has the shape of a cone expanding in downward direction.

12 Claims, 3 Drawing Sheets

Figure 1
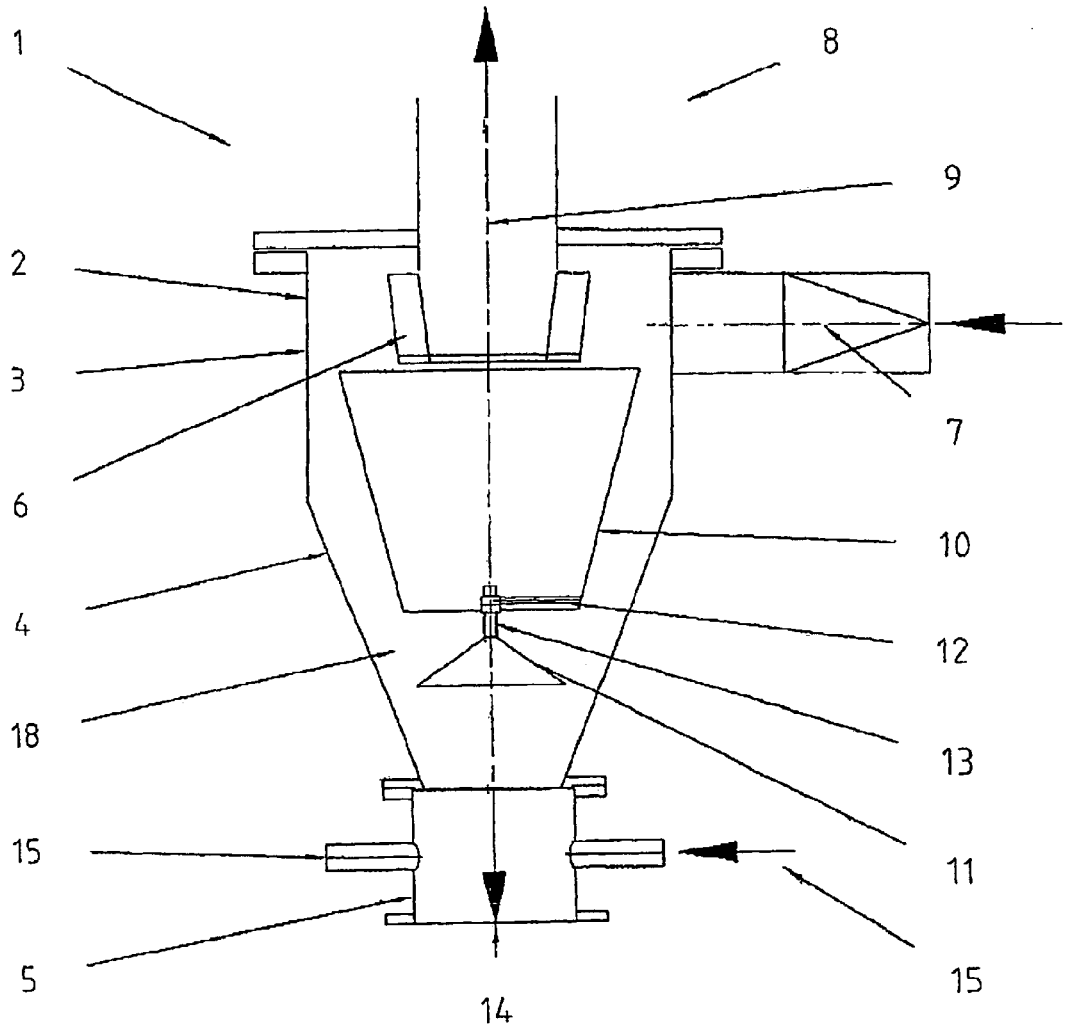
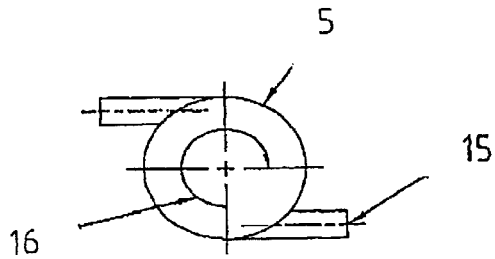
Figure 2
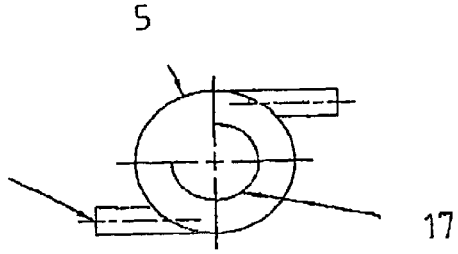
Figure 3

CYCLONE SEPARATOR WITH CENTRAL BUILT-IN ELEMENT

BACKGROUND OF THE INVENTION

The invention related to cyclone separators In addition, the invention concerns a method for influencing the granular distribution of powders while employing a cyclone separator of this kind.

During manufacture, treatment and/or processing of powders with a grain size in the $\mu$-range, ever increasing demands are made relative to granular distribution, for example in the field of producing of coating powders. Not only is observance of a given upper particle size of relevance, observance of a given particle size distribution is also demanded, i.e., different depending upon application—as a rule with respect to the percentage of fines.

A cyclone separator of the type concerned here is known from U.S. Pat. No. 6,206,202. Tests with said cyclone separator in order to exert an influence on the granular distribution of powders revealed that it does not always satisfy the altered requirements with respect to the percentage of fine particulate in the coarse granulate.

The state of the art also includes the contents of specifications FR-25 80 195A, U.S. Pat. No. 5,201,422 and FR-11 23 112 A. They disclose separators, in each case, with a housing, a separator wheel arranged therein, as well as built-in elements arranged therein. The built-in elements limit slot ranges, in which a separation effect takes place.

The present invention is based on the object of providing a cyclone separator of the previously known type with improved classification properties in order to thereby enlarge its operating field.

SUMMARY OF THE INVENTION

According to the invention, said object is attained by means of the distinguishing characteristics of the Patent Claims.

In accordance with one aspect of the present invention, a cyclone separator is provided. The separator includes a vertically extending housing. The housing includes an upper housing segment, in which is located a separator wheel, which is equipped with a carrier gas/product inlet as well as with a carrier gas/fine grain discharge. A middle housing segment tapers in conical fashion in downward direction. A central built-in element is located in the middle housing section and serves for gas/product guidance. It extends up into the upper housing segment to a lower end of the separator wheel. A lower opening of the central built-in element is located at a level of the middle housing segment. A lower housing segment is equipped with a coarse grain discharge and at least one pipe connection for secondary air supply. A cone-shaped built-in element having a shape of a downwardly expanding cone is attached to the central built-in element below the lower opening. In the region of the lower opening of the central built-in element, a reversal in air flow direction takes place. A lower edge of the cone-shaped built-in element forms, together with the housing, a slot in which counter-flow separation takes place.

In accordance with another aspect of the present invention, a method for operating a cyclone separator is provided. The separator includes a vertically extending housing with an upper housing segment in which is located a separator wheel and which is equipped with a carrier gas/product inlet and a carrier gas/fine grain discharge. A middle housing segment conically tapers in downward direction. A central built-in element is located in the middle housing segment for gas/product guidance and extends up into the middle housing segment to a lower end of the separator wheel. A lower opening of the central built-in element is located at the level of the conical housing segment. A lower housing segment is equipped with a coarse grain discharge and at least one pipe connection for secondary air supply. A conical built-in element has the shape of a downwardly enlarging cone, fastened to and below the lower opening of the central built-in element. A lower edge of the conical built-in element forms, with the housing, a slot. The method includes separating fine and coarse grains at the separator wheel to alter a fines percentage of a grain distribution and adjusting the fines percentage of the grain distribution by at least one of: changing a number of revolutions of the separator wheel, changing a volume of supplied secondary air, and changing a height of the conical built-in element.

By means of the built-in elements in the invention-specific cyclone separator, controlled flow guidance is attained, which, compared with the state of the art, provides improved classification results. The lower, cone-shaped built-in element forms a defined slot with the housing. Said slot is of decisive importance for the improved classification properties of the invention-specific cyclone separator. By adjustment of the slot size, it is possible to influence the granular distribution of the powder to be processed.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 1 is a diagrammatic side sectional view of a cyclone separator in accordance with the present invention;

FIG. 2 is a top view of a lower separator section of FIG. 1;

FIG. 3 is a top view of an alternate embodiment of the lower section of the cyclone separator of FIG. 1;

DETAILED DESCRIPTION OF THE PREFERRED EMBODIMENTS

Figure 4:
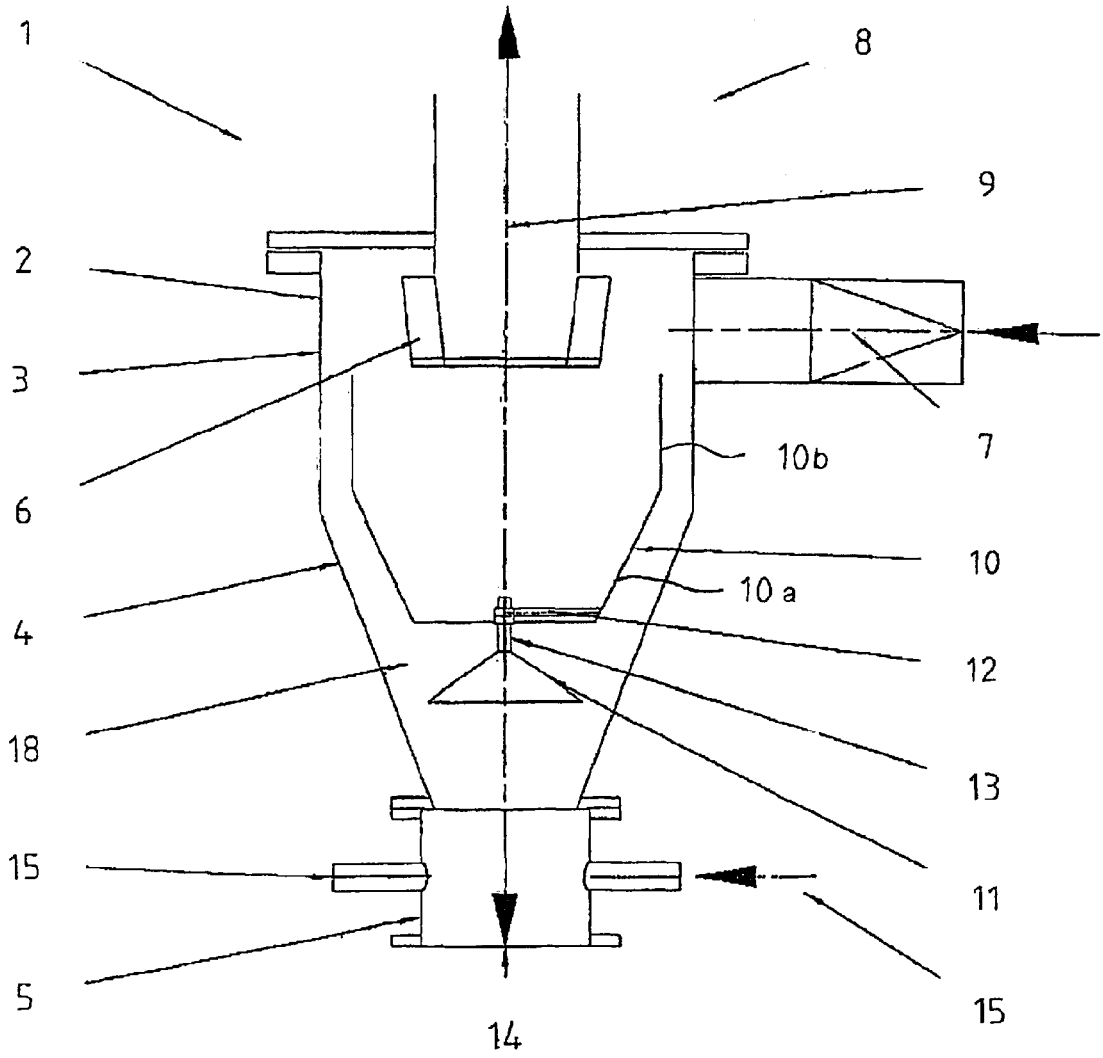
FIG. 4 is a diagrammatic vertical sectional view of an alternate embodiment of the cyclone separator; and, FIG. 5 is a diagrammatic side sectional view of vet another alternate embodiment of the cyclone separator.

In all Figures, the housing of cyclone separator 1 is identified with 2, its upper segment with 3, its middle, in downward direction conically tapering segment with 4, and its lower segment with 5. In the upper segment 3 is located a separator wheel 6. Only the separator wheel is represented schematically. In addition, the upper segment is laterally equipped with a carrier gas-/product inlet 7 (preferably arranged tangentially) and with a carrier gas/fine grain product discharge 8 (centrally arranged). The axis of the system is identified with 9.

Approximately at the level of the middle segment 4 are located two centrally arranged, rotation-symmetrical built-in elements. Involved is, firstly, a built-in element 10, open at the top and the bottom, tapering in downward direction (at least in the region of its lower segment), whose upper diameter is greater than the diameter of the separator wheel 6. It can extend up to the upper, preferably cylindrical segment 3 of housing 2 and stop directly below the separator wheel 6. Below the built-in element 10 is located the second built-in element which is arranged, at a distance, below the lower opening of the built-in element 10, and which has the shape of a conical cover expanding in downward direction. Said cone-shaped built-in element 11 is attached to the built-in element 10 in height-adjustable fashion. For that purpose, a brace 12 attached to the built-in element 10 is provided, with a support 13 of the cone 11 being mounted in height-adjustable fashion to said brace, for example by means of a screw thread.

Figure 5:
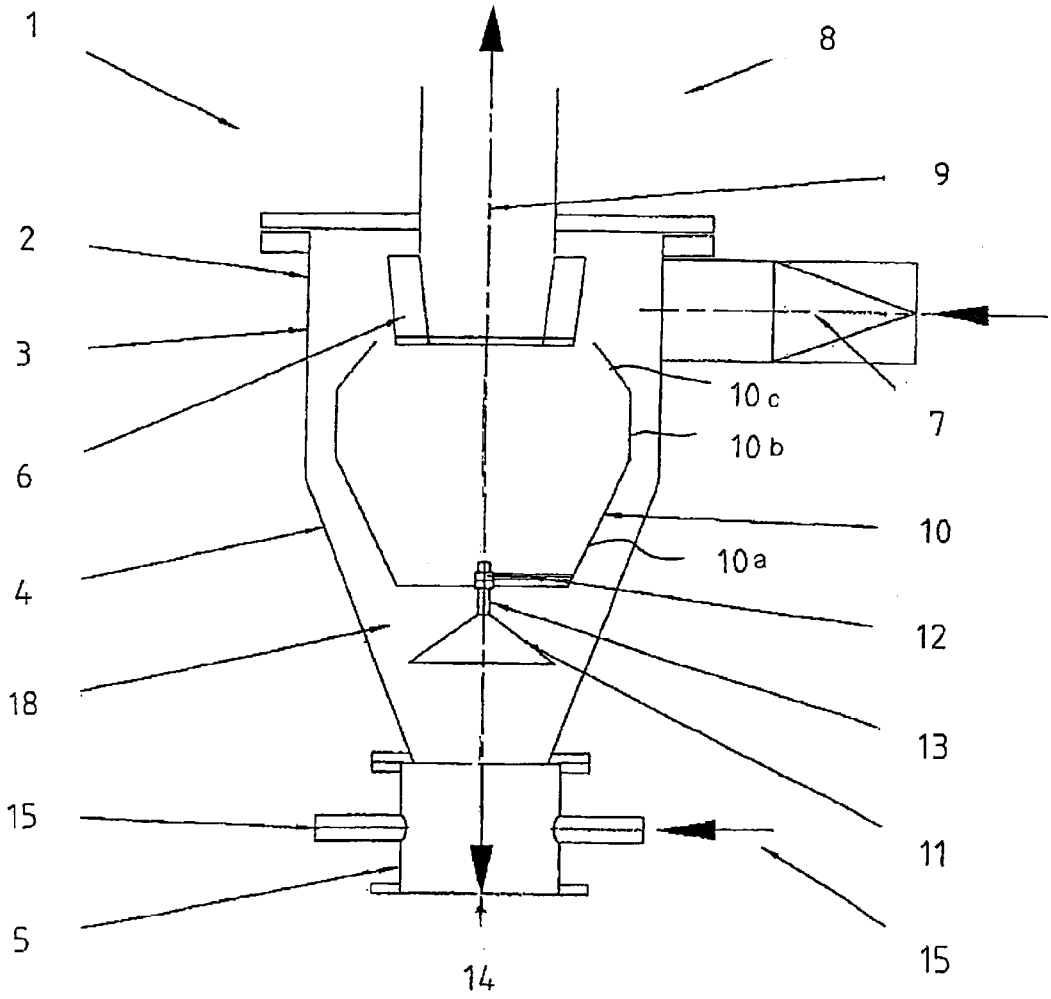

The lower housing segment 5 is equipped with a coarse grain discharge, not shown in detail, (indicated by arrow 14). In addition, one or several (two are represented) pipe connections 15 are provided for the supply of secondary gases, preferably secondary air. These may issue radially into the lower housing segment 5 (FIGS. 1, 4, and 5).

Tangentially issuing pipe connections 15 are represented in FIGS. 2 and 3. The solutions according to said Figures differ in the rotational direction of the vortices which are generated by the entering secondary air flows (arrows 16, 17).

During operation of the cyclone separator 1 according to the invention, the product-/carrier gas flow enters tangentially at the level of the separator wheel 6 into the upper segment 3 of housing 2. Extremely fine particles follow the carrier gas through the separator wheel 6 and leave the housing 2 via the carrier gas-/fine grain discharge 8. The remaining portion of the supplied product-/carrier gas stream flows, in downward direction, in spirally-shaped paths, into the annular chamber between the built-in element 10 and the external housing 2. The purpose of built-in element 10, which is known by itself, is to separate from each other the carrier gas-/particle streams which are oriented in downward direction in the peripheral region and in upward direction in the central region.

The lower built-in element 11 forms a defined slot with the outer housing 2. In the area of said slot occurs another separation of the downwardly oriented carrier gas-/particle streams. Said separation is particularly effective, if a counter flow is generated at the lower housing segment 5, in the region of slot 18, with the aid of secondary air, supplied via the pipe connections 15. It may be of benefit to also supply the secondary air tangentially, that is to say either in the same direction or in the opposite direction relative to the supply of the carrier gas-/particle stream. The fine grain product separated in slot 18 is once more conducted to the separator 6 through the interior of the built-in element 10. The product which passes through slot 18 is discharged as coarse granulate.

The cone-shaped built-in element 11 has the object of firstly preventing repeat ascent of the product located in the lower region of housing 2 due to flow turbulence. In addition to the number of revolutions of separator 6 and the supplied secondary air volume, the slot size 18 influences the percentage of fines of the fine-grained product. Due to the fact that the size of slot 18 is adjustable, it is also possible to vary the percentage of fines of the fine-grained product.

In FIG. 1, the built-in element 10 presents, over its entire height, a conically, in downward direction tapering form. The plane of its upper opening lies directly below the separator wheel 6. The plane of its lower opening lies in the area of the middle level of the conical segment 4 of the outer housing 2.

FIGS. 4 and 5 depict further embodiments of the built-in element 10. It presents, similar to housing 2, differing segments.

In the embodiment according to FIG. 4, a lower conical segment 10*a* is provided and an upper cylindrical segment 10*b*. The transition from cylindrical to conical is arranged approximately at the same level as with the outer housing 2. (Transition from segment 3 to segment 4).

In the embodiment according to FIG. 5, the upper opening of the built-in element 10 is followed by an initially conically in downward direction expanding segment 10*c*. Said segment, as represented in FIG. 5, can change over into the cylindrical segment 10*b*, or directly into the in downward direction conically tapering segment 10*a*.

As already mentioned, the cyclone separator according to the invention not only possesses improved classification properties; in addition, it allows to exert an influence, in targeted fashion, upon the size of the percentage of fines in fine-grained powder. Tests have shown that fines percentage $<10\mu$ is variable within relatively large ranges. By changing only the secondary air volume or the peripheral velocity of the separator wheel it is possible to already adjust the fines percentage within a range which lies between a first (smaller) value and a second by up to 70% increase in value. Further influence can be exerted upon said particle size distribution by changing the size of the slot 18.

During tests with respect to the influence of number of revolutions and secondary air volume, the size of slot 18 was approximately 10 mm (with a diameter of the lower edge of the cone 11 measuring approximately 0.130 cm). By changing the height of the cone 11, slot 18 can be adjusted within a wide range.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A cyclone separator comprising:

a vertically extending housing with:

an upper housing segment, in which is located a separator wheel, which is equipped with a carrier gas/product inlet as well as with a carrier gas/fine grain discharge, a middle housing segment which tapers in conical fashion in downward direction, and in which is located a central built-in element serving for gas/product guidance, extending up into the upper housing segment to a lower end of the separator wheel, a lower opening of the central built-in element being located at a level of the middle housing segment, a lower housing segment which is equipped with a coarse grain discharge and with at least one pipe connection for secondary air supply, a cone-shaped built-in element, having a shape of a downwardly expanding cone and being attached to the central built-in element below the lower opening of the central built-in element, such that in the region of the lower opening of the central built-in element a reversal in air flow direction takes place, a lower edge of the cone-shaped built-in element forming together with the housing a slot in which takes place a counter flow separation.

2. The cyclone separator according to claim 1, wherein the central built-in element is disposed at the level of the middle housing segment, the central built-in element and the middle housing segment both having downwardly conically tapering shapes.

3. The cyclone separator according to claim 2, wherein the conicity of the central built-in element and the middle housing segment are the same.

4. The cyclone separator according to claim 1 wherein an outer edge of the cone-shaped built-in element is located in the lower region of the middle housing segment.

5. The cyclone separator according to claim 1 wherein the cone-shaped built-in element is height-adjustable.

6. The cyclone separator according to claim 1 wherein the central built-in element is cylindrical in the region of the upper housing segment.

7. The cyclone separator according to claim 1 wherein an upper opening of the central built-in element is followed by a downwardly expanding segment, which is followed, in downward direction, by one of a cylindrical segment and a conical segment.

8. The cyclone separator claim 1, further including at least one pipe connection connected to the lower housing segment for providing one of radially and tangentially oriented air supply.

9. The cyclone separator according to claim 8 wherein the carrier gas/product inlet and the at least one pipe connection are tangentially arranged in such fashion that gas vortices are generated which have an opposite rotational direction.

10. A method for operating a cyclone separator with a vertically extending housing, with an upper housing segment in which is located a separator wheel, and which is equipped with a carrier gas/product inlet, as well as with a carrier gas/fine grain discharge, with a middle housing segment which conically tapers in downward direction and in which is located a central built-in element for gas/product guidance, extending up into the upper housing segment to a lower end of the separator wheel, a lower opening of the central built-in element being located at the level of the conical housing segment, with a lower housing segment which is equipped with a coarse grain discharge and with at least one pipe connection for secondary air supply, and a conical built-in element, which has the shape of a downwardly enlarging cone, fastened to and below the lower opening of the central built-in element, a lower edge of the conical built-in element forming with the housing a slot, the method comprising:

separating fine and coarse grains at the separator wheel to alter a fines percentage of a grain distribution;

adjusting the fines percentage of the grain distribution by at least one of:

changing a number of revolutions of the separator wheel, changing a volume of supplied secondary air, and changing a height of the conical built-in element.

11. A cyclone separator comprising:

an upper housing segment;

a middle housing segment connected to a lower end of the upper housing segment, the middle housing segment having a conical taper in a downward direction;

a lower housing segment which terminates at a lower end in a coarse grain discharge;

a separator wheel mounted in the upper housing segment;

a first inlet in the upper housing section in communication with the separator wheel for introducing carrier gas and grains of product of mixed sizes;

a carrier gas and fine grain discharge connected with the upper housing segment and the carrier wheel for discharging carrier gas and separated fine grains;

a central built-in element disposed below the separator wheel, the central built-in element having an upper opening which receives carrier gas and a mixture of grains of mixed sizes from the separator wheel, the central built-in element tapering to a lower discharge opening in the middle housing segment;

a conical element mounted below the lower discharge opening of the central built-in element, the conical element defining an annular gap between a lower peripheral edge and the middle housing segment, at least coarse grains passing downward through the gap to the lower housing segment; and at least one secondary supply line which provides a secondary supply of air to the lower housing segment, the secondary air moving upward through the gap between the conical element and the middle housing segment carrying fine particles upward between the central built-in element and the middle and upper housing segments to be re-entrained in the input carrier gas and fed to the separator wheel.

12. The cyclone separator according to claim 11 further including a means for adjusting a position of the conical element to adjust a size of the gap between the conical element and the middle housing segment.

* * * * *